US008328450B2

(12) United States Patent
Smith et al.

(10) Patent No.: US 8,328,450 B2
(45) Date of Patent: Dec. 11, 2012

(54) APPLICATORS

(75) Inventors: Matthew Eric Smith, Isle of Man (GB); Karl Mondszein, Mansfield (GB)

(73) Assignee: Carbonite Corporation (PA)

( * ) Notice: Subject to any disclaimer, the term of this patent is extended or adjusted under 35 U.S.C. 154(b) by 410 days.

(21) Appl. No.: 12/739,067

(22) PCT Filed: Oct. 28, 2008

(86) PCT No.: PCT/GB2008/003652

§ 371 (c)(1),
(2), (4) Date: Jun. 8, 2010

(87) PCT Pub. No.: WO2009/056819

PCT Pub. Date: May 7, 2009

(65) Prior Publication Data

US 2010/0303535 A1 Dec. 2, 2010

(30) Foreign Application Priority Data

Oct. 29, 2007 (GB) ..... 0721186.5

(51) Int. Cl.
*B43M 11/06* (2006.01)

(52) U.S. Cl. ..... 401/186; 401/183; 401/263; 222/494

(58) Field of Classification Search ..... 401/183–186, 401/261, 263, 265, 266; 222/387, 491, 494, 222/495

See application file for complete search history.

(56) References Cited

U.S. PATENT DOCUMENTS

| | | | | |
|---|---|---|---|---|
| 2,667,992 A | | 2/1954 | Hammond et al. | |
| 5,115,950 A | | 5/1992 | Rohr | |
| 5,743,441 A | | 4/1998 | Baudin et al. | |
| 5,772,347 A | * | 6/1998 | Gueret | 401/263 |
| 5,779,109 A | * | 7/1998 | Gueret | 222/494 |
| 6,536,631 B1 | * | 3/2003 | Nickels et al. | 222/212 |
| 7,108,442 B2 | * | 9/2006 | DuFour | 401/263 |

FOREIGN PATENT DOCUMENTS

| | | |
|---|---|---|
| DE | 102 47 246 A1 | 4/2004 |
| EP | 0 554 181 A1 | 8/1993 |
| WO | WO 99/41158 A1 | 8/1999 |

OTHER PUBLICATIONS

International Search Report and Written Opinion of PCT/GB2008/003652.

* cited by examiner

*Primary Examiner* — David Walczak
(74) *Attorney, Agent, or Firm* — Cowan, Liebowitz & Latman, P.C.; Lloyd McAulay, Esq.; Mark Montague, Esq.

(57) ABSTRACT

An applicator for applying a substance in liquid, paste or gel form comprises a container (2), of which a portion is flexible and which includes an applicator portion, which is arcuate in cross-section and in which one or more first apertures (14) is formed. An elastic valve membrane (18) is connected to and overlies the applicator portion and one or more second apertures (22) are formed in it. The first apertures (14) are offset from the second apertures (22). The valve membrane (18) normally engages the applicator portion and the first apertures (14) are thus normally closed by the valve membrane (18) but the application of pressure to the flexible portion of the container produces an increase of the pressure of the container which results in the valve membrane (18) being forced away from the applicator portion against its elasticity. The second apertures (22) are slits, which are closed when the valve membrane (18) is in engagement with the applicator portion but which are open when the valve membrane (18) is forced away from the applicator portion.

6 Claims, 4 Drawing Sheets

APPLICATORS

CROSS-REFERENCE TO RELATED APPLICATIONS

This application claims priority to International Application No. PCT/GB2008/0036252 filed on Oct. 28, 2008 and Great Britain Application No. 0721186.5 filed Oct. 29, 2007, the entire disclosures of which are hereby incorporated by reference.

The present invention relates to applicators for applying a substance in liquid, paste or gel form to a surface, particularly the human body, and is particularly concerned with deodorant applicators, that is to say devices for the application to the human skin of a deodorant or fragrant composition for the purpose of suppressing or masking natural body odour. More specifically, the invention relates to applicators of the type comprising a container, of which at least a portion is flexible and which includes an applicator portion, which is arcuate in cross-section and in which one or more first apertures is formed, and an elastic valve membrane, which is connected to and overlies the applicator portion and in which one or more second apertures is formed, the first apertures being offset from the second apertures, wherein the valve membrane normally engages the applicator portion and the first apertures are thus normally closed by the valve membrane but the application of pressure to the flexible portion of the container will produce an increase in pressure in the container which results in the valve membrane being forced away from the applicator portion against its elasticity.

Three basic types of deodorant applicator are known and in widespread use. The first is of stick type in which a stick of waxy carrier material impregnated with a deodorant composition is accommodated within a tube, with one end of the stick exposed. The stick is rubbed against the skin, thereby applying a small amount of the carrier material and thus also of the deodorant composition to the skin. However, the deodorant composition is relatively volatile and progressively evaporates from the waxy carrier material and such stick deodorants therefore progressively become increasingly ineffective. The second known type of deodorant applicator is of so-called roller ball type in which the deodorant composition is received in liquid form in a container, the upper end of which affords a part-spherical seat in which a spherical applicator ball is rotatably received. If the container is inverted and the applicator ball is rolled against the skin, the ball will rotate in its mounting and a thin layer of deodorant composition is transferred from the interior of the container to the skin on the surface of the ball. The problem with this applicator is the substantial expense involved in the manufacture of the applicator ball and its seat. The third known type of deodorant applicator is of pressurised aerosol type. The deodorant composition is stored together with propellant in an aerosol can and is sprayed as desired onto the skin. However, quite apart from the fact that a significant proportion of the deodorant composition is inevitably lost to the atmosphere during application, aerosol cans are expensive to manufacture and their use is increasingly thought to be undesirable for environmental reasons.

A fourth type of applicator, which is of the type referred to in the initial paragraph, is known from U.S. Pat. No. 5,743,441 (Baudin). Two problems exist with this type of applicator. Firstly, the substance dispensed tends to solidify in the apertures in the membrane, thereby blocking them and preventing subsequent dispensing of the substance in the reservoir. Secondly, after some of the substance has been expelled from the reservoir by the action of a user exerting pressure on the reservoir thereby deforming it and increasing the pressure within it, when the pressure on the reservoir is released the membrane moves back into contact with the applicator portion. There then exists no path through which air is able to pass into the container in order to replace the volume of substance previously dispensed. The reservoir therefore remains at a pressure which is below atmospheric pressure and so remains in a deformed shape, which is undesirable both aesthetically and because it renders subsequent dispensing of the substance more difficult.

It is therefore the object of the invention to provide an applicator which overcomes the disadvantages referred to above and which, in particular, is cheap and simple to manufacture and permits long-term storage of a substance in liquid, paste or gel form without loss or degradation.

According to one aspect of the present invention, an applicator of the type referred to above is characterised in that the second apertures are slits which are closed when the valve membrane is in engagement with the applicator portion and are open when the valve membrane is forced away from the applicator portion.

Thus the applicator in accordance with the invention will contain, in use, a composition in flowable form, typically a deodorant composition. The interior of the container potentially communicates with the atmosphere via a plurality of apertures formed in the applicator portion of the container. A valve membrane of elastic or resilient material is connected to the container and overlies the applicator portion and a plurality of slits is formed in it. The apertures are offset from the slits. The valve membrane normally engages the surface of the applicator portion and thus normally closes or seals the apertures. Undesired discharge of the deodorant composition to the atmosphere and evaporation of the deodorant composition are therefore prevented. However, if the container is inverted and pressure is applied to the flexible portion of the container, the pressure within the container will be increased. This increased pressure will act on the underside of the valve membrane which will thus be caused to move away from the applicator portion by the action of the pressure acting on it through the apertures. This will result in the creation of a narrow gap between the surface of the applicator portion and the opposed surface of the valve membrane. Deodorant composition will then flow into this gap under the application of the increased pressure and from there will apply pressure to the underside of the valve membrane, causing deformation of the membrane around the slits, thereby opening the slits and flowing through them to the atmosphere. The applicator portion is placed in contact with the skin and a layer of deodorant composition is thereby applied to the skin. When the pressure applied to the flexible portion of the container is removed, the pressure within the container will decrease, potentially to a sub-atmospheric value, and the deodorant composition within the gap between the applicator portion and the valve membrane will be sucked back into the container. The valve membrane will then return back into contact with the applicator portion under the action of the reduced pressure and also the action of its own resilience. The slits will close completely under the action of the resilience of the valve membrane and the apertures will be closed again by the engagement of the valve membrane with the applicator portion and the interior of the container will thus again be sealed against the atmosphere. Due to the fact that the slits are fully closed when the valve membrane is in contact with the applicator portion, no deodorant or other flowable material can remain within them. The risk of the flowable material remaining in the openings in the valve membrane and subsequently hardening and blocking these openings is thus eliminated.

It is preferred that the applicator portion is provided with a recess in which the valve membrane is received, the depth of the recess being substantially equal to the thickness of the valve membrane. This will result in the applicator portion affording a smooth, contiguous surface.

The valve membrane may be connected to the container in any desired manner but it will be appreciated that this connection should be at or at least in the vicinity of its peripheral edge so as to permit movability of those portions of the valve membrane which normally seal the apertures. In the preferred embodiment, the applicator portion and the peripheral edge of the valve membrane bear interlocking recess and projection means, by which the valve membrane is connected to the container.

The lower surface of the valve membrane, that is to say that surface of the valve membrane which is directed towards the surface of the applicator portion, may be smooth but in order to enhance the integrity of the seal of the apertures it is preferred that it bears a plurality of protuberances, the size and arrangement of which correspond to those of the apertures, whereby each of the apertures is normally sealed or blocked by a respective protuberance.

It is preferred that the container is of two-part type and comprises a base of flexible material, connected to which is a cap of substantially rigid material which affords the applicator portion. The cap may be connected to the base in any desired manner but it is preferred that it is snap-connected to the base.

According to a further aspect of the present invention, which may be used independently or combined with the first aspect referred to above, an applicator of the type referred to above is characterised in that a hole is formed in the applicator portion and the membrane carries a projection which is received in the hole and defines with it a first air passage which communicates with the interior of the container, the membrane and the applicator portion together defining a second air passage which communicates with the first air passage and with atmosphere, the projection carrying a resilient head portion which normally engages the internal surface of the applicator portion and forms a seal with it, thereby sealing the first air passage, but which, when a sub-atmospheric pressure prevails within the container, is deformable under the action of atmospheric pressure in the first passage to move out of engagement with the applicator portion and thus to connect the interior of the container with the atmosphere. When the pressure inside the applicator is higher than atmospheric pressure, the head portion is pressed against the inside of the applicator portion, thus increasing the effectiveness of the seal. When the pressure inside the applicator is lower than atmospheric pressure, the head portion is deformed away from the inside of the applicator portion, thus breaking the seal and allowing air to be admitted into the applicator. In this way, the or each vent plug acts as a one way valve, permitting air to pass into the applicator but preventing substances from passing out of the applicator. This allows a sub-atmospheric pressure inside the container to be relieved and thereby allows the container to revert to its original, undistorted shape.

The or each projection with its enlarged head portion and the hole in the applicator portion in which it is received thus serve two unrelated functions. Thus they not only act to retain the membrane in position but also act as non-return valves to admit air into the container after some of its contents have been dispensed.

Further features and details of the invention will be apparent from the following description of one specific embodiment which is given by way of example only with reference to the accompanying diagrammatic drawings, in which.

Figure 1:
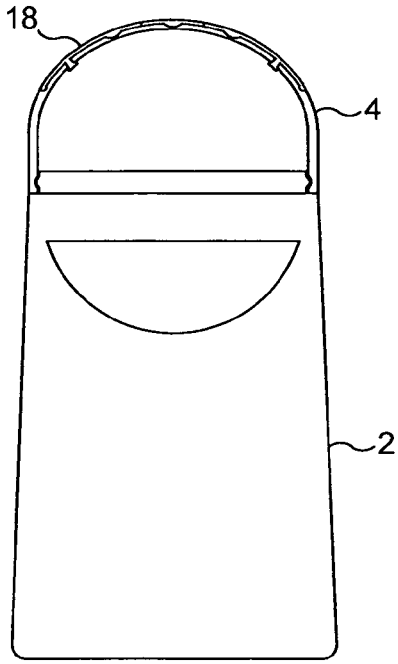
FIG. 1 is a front view of a deodorant applicator in accordance with the invention.

The applicator illustrated in the drawings comprises a container consisting of a base 2 and a cap 4. The base 2 is made of flexible plastic material, such as polypropylene, and is of generally rectangular shape, in horizontal cross-section. The cap 4 is of rigid plastic material, e.g. polyethylene. Its shape at its lower end matches that of the upper end of the base but its upper end is domed, that is to say of arcuate section in vertical section. The cap consists of a thin hollow shell, on the inner surface of the lower open end of which there is an annular inward protuberance 6, above which there is an annular recess 8. At the top of the base 2 there is an annular horizontal shoulder, upstanding from which is an annular flange 10. Formed on the external surface of the flange 10 is an outward annular protuberance 12. The cap is snap-fitted to the base by forcing the annular protuberance 6 over the annular protuberance 12, whereafter the cap is locked to the base.

Figure 4:
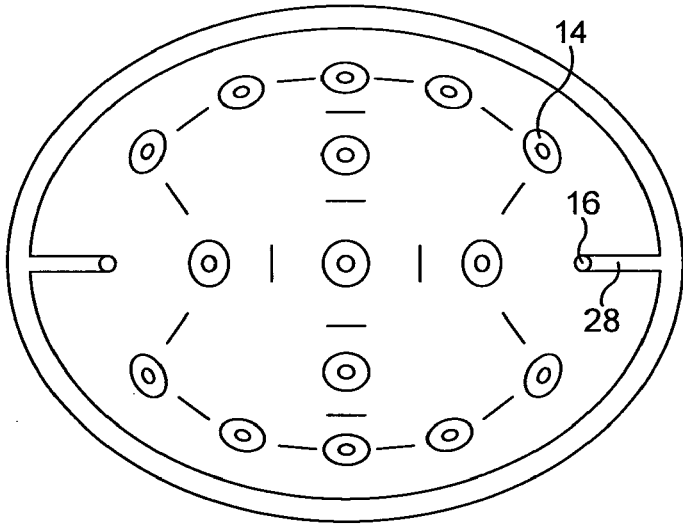
FIG. 4 is a plan view of the applicator of FIGS. 1 and 2 with the valve membrane removed, showing the orifices and the applicator portion and the relative positions of the slits.
Figure 5:
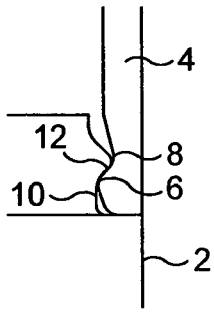
FIG. 5 shows the engagement of the cap with the container in more detail.
Figure 6:
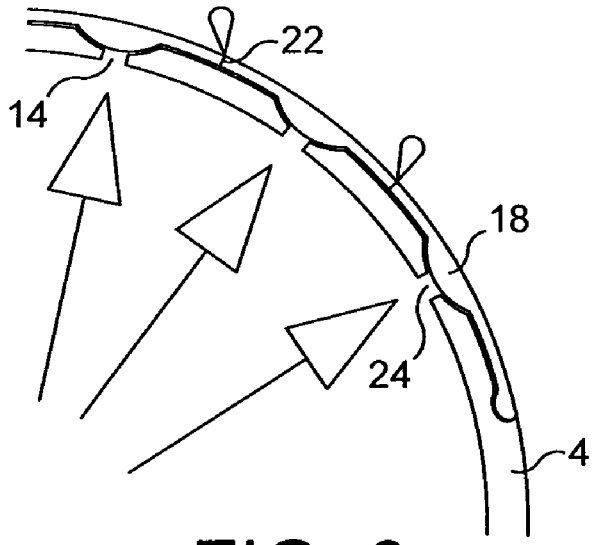
FIG. 6 is an enlarged view of a portion of the membrane and applicator portion as pressure inside the container forces substance through and out of the slits.
Figure 7:
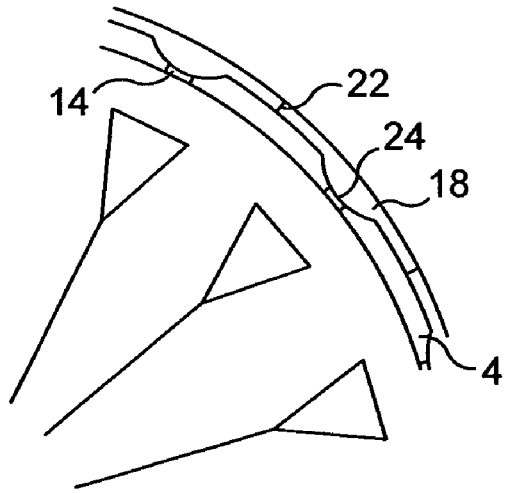
FIG. 7 is a view similar to FIG. 6 showing the slits in the membrane in the closed position.
Figure 8:
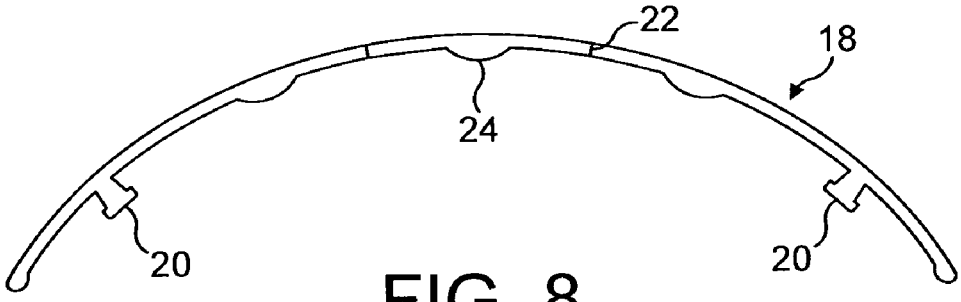
FIG. 8 shows the membrane in more detail.
Figure 9:
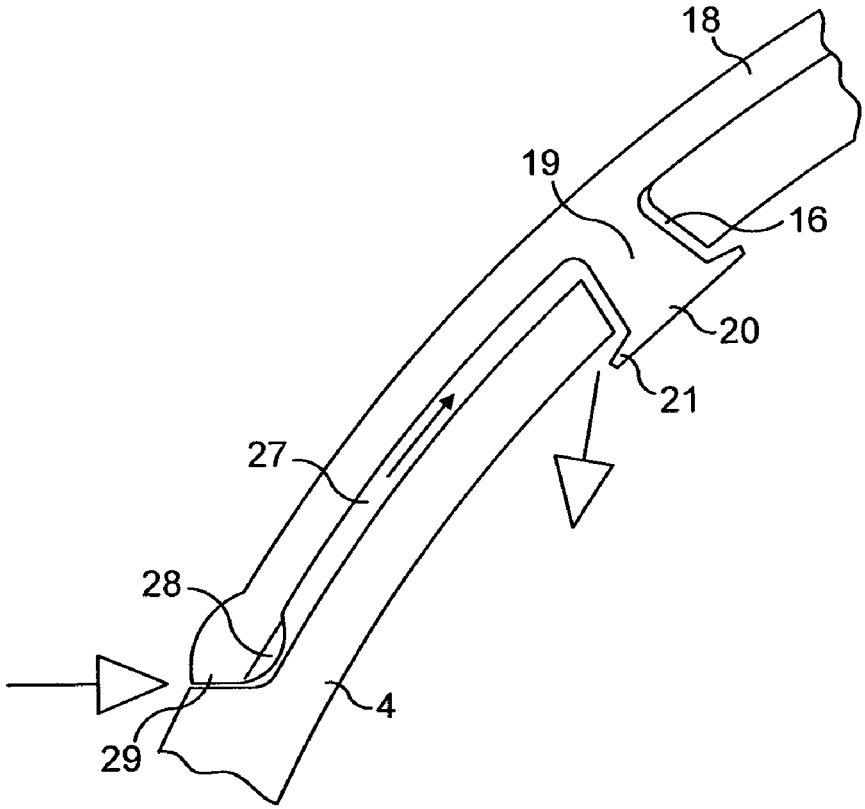
FIG. 9 shows the vent plug and membrane peripheral edge in more detail.

Formed in the upper surface of the domed portion of the cap 4 is a shallow recess, whose depth is typically 1 to 3 mm. This recessed region constitutes the applicator portion of the container. Formed in the base of the recess is a plurality of small apertures 14, as seen in FIG. 4. Formed in the base of the recess is a number, in this case two, of holes 16, the purpose of which will be described below. Situated within the recess in the cap is a valve membrane 18 of elastic material, in this case of elastomeric material. The thickness of the membrane 18 is generally equal to the depth of the recess which means that the upper surface of the cap and membrane afford a smooth contiguous surface. Integrally depending from the underside of the membrane 18 are two pegs constituting vent plugs 20 of generally mushroom shape. Each peg comprises a stem 19 of slightly increasing cross-sectional area in the downward direction and terminates in a head 21 whose diameter is greater than that of the holes 16. The positions of the vent plugs 20 correspond to those of the holes 16. When the membrane 18 is to be connected to the container, the vent plugs 20 are aligned with the holes 16 and are forced into the holes 16 and the vent plugs 20 are then retained in the holes by the heads 21 and thus retain the membrane 18 in position in the recess.

Figure 3:
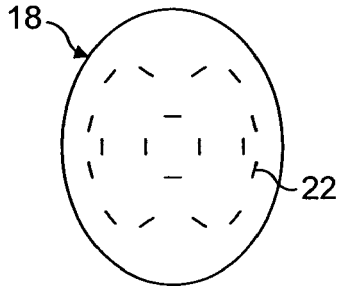
FIG. 3 is a plan view of the applicator of FIGS. 1 and 2 showing the slits in the valve membrane.

The membrane 18 has a plurality of slits 22 formed in it, as seen in FIG. 3. When the membrane 18 is in position, the slits 22 are offset from the apertures 14 and each aperture 14 is therefore covered by elastomeric material. In practice, the spacing of the vent plugs 20 on the membrane 18, when in the relaxed state, is slightly less than that of the holes 16, which means that when the membrane is attached to the container, it is necessary to stretch it slightly against its elasticity. This means that the membrane is slightly tensioned and as a result of the dome shape of the cap this tension will hold it in firm contact with the surface of the recess and thus ensure that the apertures 14 are sealed by the membrane.

The membrane 18 has a smooth outer surface. It may also have a smooth inner surface engaging the surface of the recess in the cap but in this preferred embodiment it is provided with a plurality of integral depending protuberances 24, the size and arrangement of which corresponds to that of the apertures 14. Each aperture 14 thus cooperates with and is effectively sealed by a respective protuberance 24.

The stem 19 of each vent plug has a diameter somewhat smaller than that of the hole 16 in which it is received thereby defining a gas passage. The length of each stem is very slightly less than the thickness of the cap 4 in the region of the recess in its upper surface. The head 21 of each vent plug is therefore normally in sealing contact with the underside of the cap 4. Formed in the underside of the membrane 18 or, as in this case, in the upper surface of the applicator portion 4, and associated with each hole 16 is a gas passage 27, one end of which communicates with the associated hole 16 and the other end of which communicates with the atmosphere via one or more slots 28 formed in a bulbous portion 29 at the free edge of the membrane 18.

Figure 2:
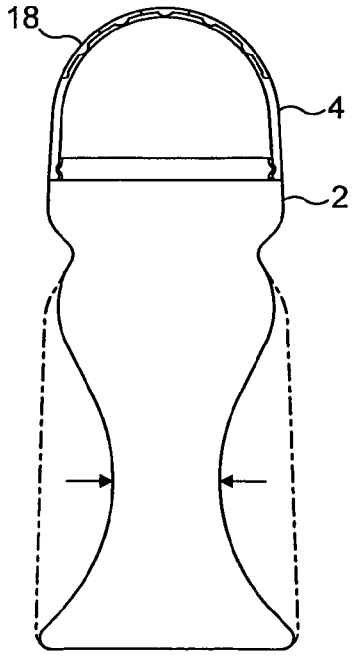
FIG. 2 is a side view of the applicator of FIG. 1 showing the contour of the container when squeezed to apply deodorant composition.

In use, the base 2 of the container is filled with e.g. a liquid deodorant preparation and the cap 4 is then snap-connected to it by the application of a substantial downward force. It will of course be appreciated that any appropriate form of connection may be used between the base and the cap. Either before or after the application of the cap to the base, the valve membrane 18 is positioned within the recess in the top of the cap and fastened in position by means of the vent plugs 20. The tension in the membrane 18 coupled with the provision of the protuberances 24 on the membrane 18 and the seal between the heads 21 of the vent plugs and the underside of the cap ensure that the container is sealed and there is therefore no evaporation or atmospheric degradation of the deodorant composition. If it should be desired to apply the deodorant composition, the container is inverted and pressure is applied to its side walls, thereby deforming it in the manner shown in FIG. 2. This deformation results in an increase in the pressure within the container and this increased pressure acts on the underside of the membrane 18 through the apertures 14. The membrane is therefore caused to move away slightly from the base of the recess against its elasticity. This movement of the membrane results in the creation of a narrow gap between the membrane and the base of the recess, into which the deodorant composition will flow under the action of the increased pressure in the container. Pressure exerted on the underside of the membrane causes local deformation of the membrane around the slits 22, causing the slits to open when sufficient pressure is exerted. Deodorant composition can then flow through the slits 22 in the membrane and be applied to the skin of the user. The increased pressure in the container acts on the heads 21 of the vent plugs thereby increasing their contact pressure with the underside of the cap 4 and thus increasing the integrity of the seal of the holes 16. When sufficient deodorant composition has been applied, the pressure on the base 2 of the container is relaxed. This results in a reduction in the pressure within the container and the deodorant composition situated in the gap between the membrane and the base of the recess is then drawn back into the container. The membrane returns to its original position in contact with the base of the recess under the action of the reduced pressure within the container and/or under the action of its own elasticity. The apertures 14 in the base of the recess are then re-sealed and the interior of the container is then sealed again from the atmosphere. When the pressure exerted on the underneath of the membrane falls, the slits 22 close under the action of the membrane's elasticity. This action expels excess substance which might otherwise dry in situ and either block the slits or be seen as undesirable by a user.

When the pressure inside the applicator is less than atmospheric pressure, the air within the holes 16, which is at atmospheric pressure because they communicate with the atmosphere through the passages 27, 28, exert a force on the heads 21 of the vent plugs and force them out of contact with the underside of the cap. Air thus flows through the channels 28 in the applicator portion to the vent plugs 20, and from there through the associated holes 16 into the container. This results in equalisation of the pressure inside the container with atmospheric pressure and allows the container to return to its original shape under the action of its own resilience.

It will be appreciated that numerous modifications may be effected to the specific embodiment described above. In particular, it will be appreciated that the one-way valves, comprising the mushroom-shaped vent plugs and associated holes in the applicator head, may be omitted or may be employed independently of the provision of the slits in the membrane and that a different number of one-way valves could be employed. Furthermore, whilst the applicator is primarily intended for use with deodorant compositions, it will be appreciated that it may also be used to apply other substances, such as anti-perspirant compositions, shaving gel or therapeutic cream.

The invention claimed is:

1. An applicator for applying a substance in liquid, paste or gel form comprising a container, of which at least a portion is flexible and which includes an applicator portion, which is arcuate in cross-section and in which one or more first apertures is formed, and an elastic valve membrane, which is connected to and overlies the applicator portion and in which one or more second apertures is formed, the first apertures being offset from the second apertures, wherein the valve membrane normally engages the applicator portion and the first apertures are thus normally closed by the valve membrane but the application of pressure to the flexible portion of the container will produce an increase in pressure in the container which results in the valve membrane being forced away from the applicator portion against its elasticity, the second apertures being slits which are closed when the valve membrane is in engagement with the applicator portion and are open when the valve membrane is substantially forced away from the applicator portion, characterised in that a hole is formed in the applicator portion and the membrane carries a projection which is received in the hole and defines with it a first air passage which communicates with the interior of the container, that the membrane and the applicator portion together define a second air passage which communicates with the first air passage and with atmosphere, and that the projection carries a resilient head portion which normally engages the internal surface of the applicator portion and forms a seal with it, thereby sealing the first air passage, but which, when a sub-atmospheric pressure prevails within the container, is deformable under the action of atmospheric pressure in the first passage to move out of engagement with the applicator portion and thus to connect the interior of the container with the atmosphere.

2. An applicator as claimed in claim 1 in which the applicator portion is provided with a recess in its surface, in which the valve membrane is received, the depth of the recess being substantially equal to the thickness of the valve membrane.

3. An applicator as claimed in claim 2 in which the applicator portion bears interlocking recess and projection means by which the applicator portion is connected to the container.

4. An applicator as claimed in claim 1 in which the applicator portion bears interlocking recess and projection means by which the applicator portion is connected to the container.

5. An applicator as claimed in claim 1 in which that surface of the valve membrane which is directed towards the applicator portion bears a plurality of protuberances, the size and arrangement of which corresponds to those of the first apertures, whereby each of the first apertures is normally blocked by a respective protuberance.

6. An applicator as claimed in claim 1 in which the membrane carries a plurality of projections, each of which is received in a respective hole in the applicator portion.

* * * * *